United States Patent [19]

Knabel

[11] Patent Number: 4,600,212

[45] Date of Patent: Jul. 15, 1986

[54] ELECTRONIC SKI BINDING AND A METHOD FOR ITS OPERATION

[75] Inventor: Walter Knabel, Murnau, Fed. Rep. of Germany

[73] Assignee: Marker International Company, Salt Lake City, Utah

[21] Appl. No.: 708,288

[22] Filed: Mar. 5, 1985

[30] Foreign Application Priority Data

Jun. 3, 1984 [DE] Fed. Rep. of Germany ..... 3408129

[51] Int. Cl.[4] ..... A63C 9/08

[52] U.S. Cl. ..... 280/611; 280/612; 307/116; 361/170

[58] Field of Search ..... 280/611, 612, DIG. 13; 307/116, 119; 361/170

[56] References Cited

U.S. PATENT DOCUMENTS

| | | | |
|---|---|---|---|
| 4,291,894 | 9/1981 | D'Antonio | 280/612 |
| 4,458,157 | 7/1984 | Knabel | 280/612 |
| 4,482,168 | 11/1984 | Oberleitner | 280/612 |
| 4,494,767 | 1/1985 | Campillo | 280/612 |
| 4,545,598 | 10/1985 | Spitaler | 280/612 |

*Primary Examiner*—John J. Love
*Assistant Examiner*—Joseph G. McCarthy
*Attorney, Agent, or Firm*—D. Peter Hochberg

[57] ABSTRACT

An electronic ski binding incorporating a capacitor for generating actuating signals to a release circuit, and a recharging circuit for recharging the capacitor from an energy source according to the energy level of the capacitor. A charge measuring circuit is provided for measuring the charge of the energy source according to the time required to recharge the capacitor.

11 Claims, 5 Drawing Figures

ELECTRONIC SKI BINDING AND A METHOD FOR ITS OPERATION

The invention relates to a method for operating an electronic ski binding. The invention also relates to an electronic ski binding per se.

Electronic ski bindings comprise in general an electronic portion and a mechanical portion. Electro-mechanical transducer means are usually provided at the interface between the electronic portion and the mechanical portion. The transducer means may comprise for instance an electro-magnetic device such as a solenoid. The electronic portion is supplied with electric signals which are in relation to the forces applied to the ski boot. The electronic part determines whether certain predetermined threshold values are exceeded or not. As soon as predetermined threshold values are exceeded and it is required to release the ski binding, a release circuit is activated. The release circuit thereupon activates a release element such as a release capacitor, to supply electrical energy to the electro-mechanical transducer, which in turn actuates the mechanical portion to release the ski boot.

The electronic ski bindings of the prior art require, after the skier has stepped into the binding, a certain time period during which the release capacitor is charged up to the required voltage or energy which is necessary to effect the release. This time period is consumed at a time when the ski binding is already in its operational condition, i.e., ready to be used. However, during the time period within which the charging takes place, the ski binding is, for all practical purposes, not yet ready to be released.

It is an object of the present invention to overcome this disadvantage. Another object of the invention is to connect the battery of the ski binding all the time, i.e., also during the time the binding is in its condition of non-use, with the release capacitor or the like in such a manner that the release capacitor always stores electric energy. However, the other parts of the electronic portion which are not required for this storing operation, will be connected with the battery only after the skier has stepped into the binding.

It is another object of the present invention to provide for an electronic ski binding which will be ready for release immediately after the skier steps into the binding. In accordance with a preferred embodiment of the invention, it is provided that the release capacitor is charged during the condition of non-use of the ski binding at least up to an energy value which is sufficient for a single release of the binding.

In according with another preferred embodiment of the invention, it is provided that during the condition of non-use of the ski binding, the release capacitor is repeatedly charged up to a value of energy which is somewhat higher than the value of energy required for a single release. Whenever the amount of energy stored in the release capacitor decreases to an amount or value of energy which is sufficient for a single release, the release capacitor is recharged to the somewhat higher value of energy.

Another aspect of the invention involves assuring the availability of a sufficient charge condition of the battery for operating the electronic ski binding.

U.S. Pat. No. 4,291,894 discloses an electronic ski binding with means giving an indication of the condition of the battery.

In accordance with preferred embodiments of the present invention, means are provided to determine the charge condition of the battery. This is done by determining the time required for charging a capacitor. This time period is compared to a predetermined reference time period so as to determine whether the condition of charge of the battery is sufficient for a safe operation of the ski binding. If the battery is fully charged, the charging operation will be short, if the battery is partially discharged, the charging will require a longer period of time. The time period required for the charging operation can be considered as a measure of the condition of charge of the battery. In accordance with a preferred embodiment of the invention, the charging time of the release capacitor issued as the basis for determining the condition of charge of the battery.

In accordance with another preferred embodiment of the invention, the required time for charging the release capacitor is not determined beginning with a charge condition of zero, but rather starting with a partially charged release capacitor. For determining the energy or charge stored in the release capacitor, preferably the voltage across the release capacitor or an amount derived therefrom is used.

According to another preferred embodiment of the invention, the release capacitor is charged at least to twice the amount of energy required for the release. This charging operation takes place when initiating the operation of the binding, i.e., when bringing the binding into its condition of use.

Additional advantages, objects and details of the invention may be derived from the following description of embodiments of the invention in connection with the drawing. In the drawing.

Figure 4:
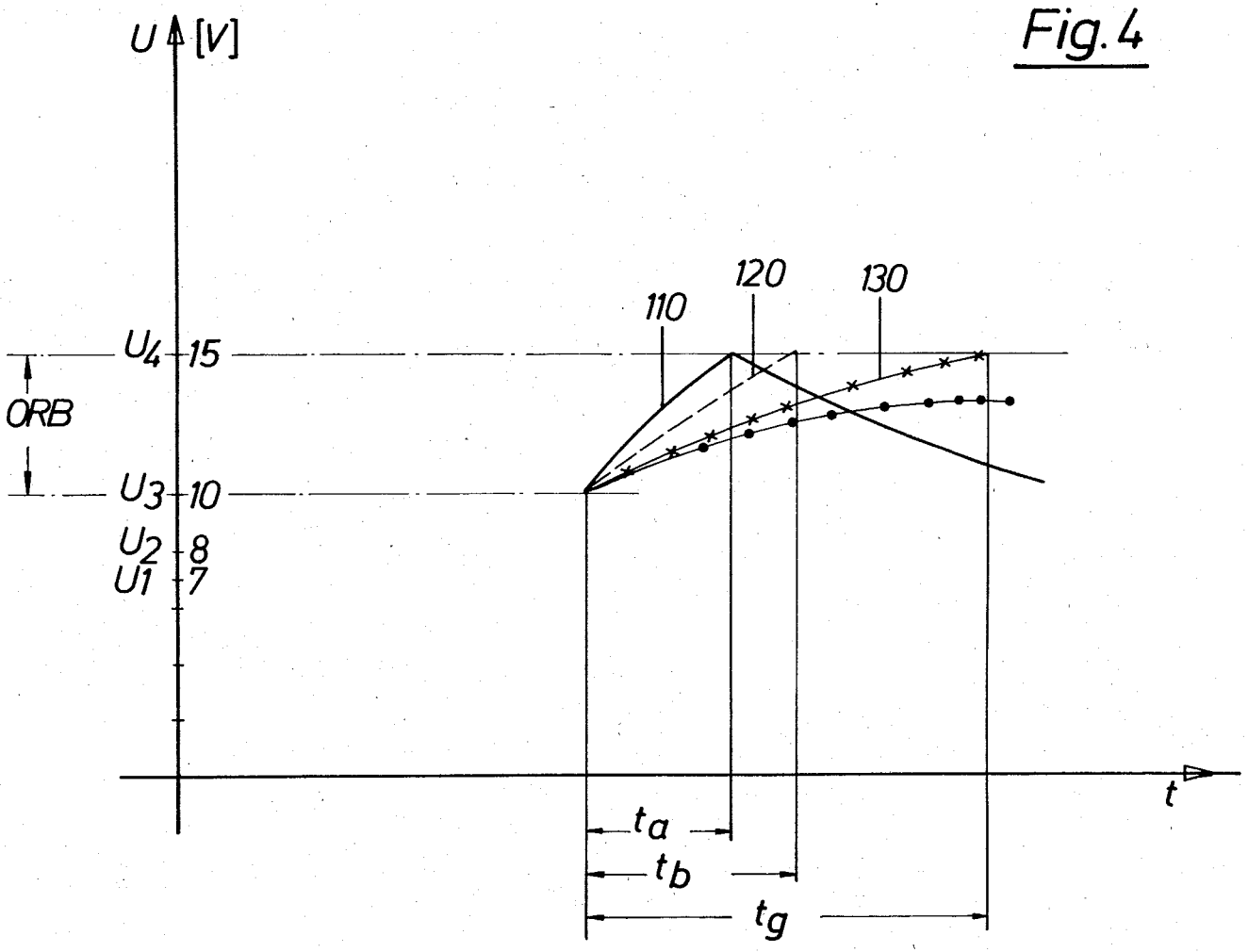
Figure 5:
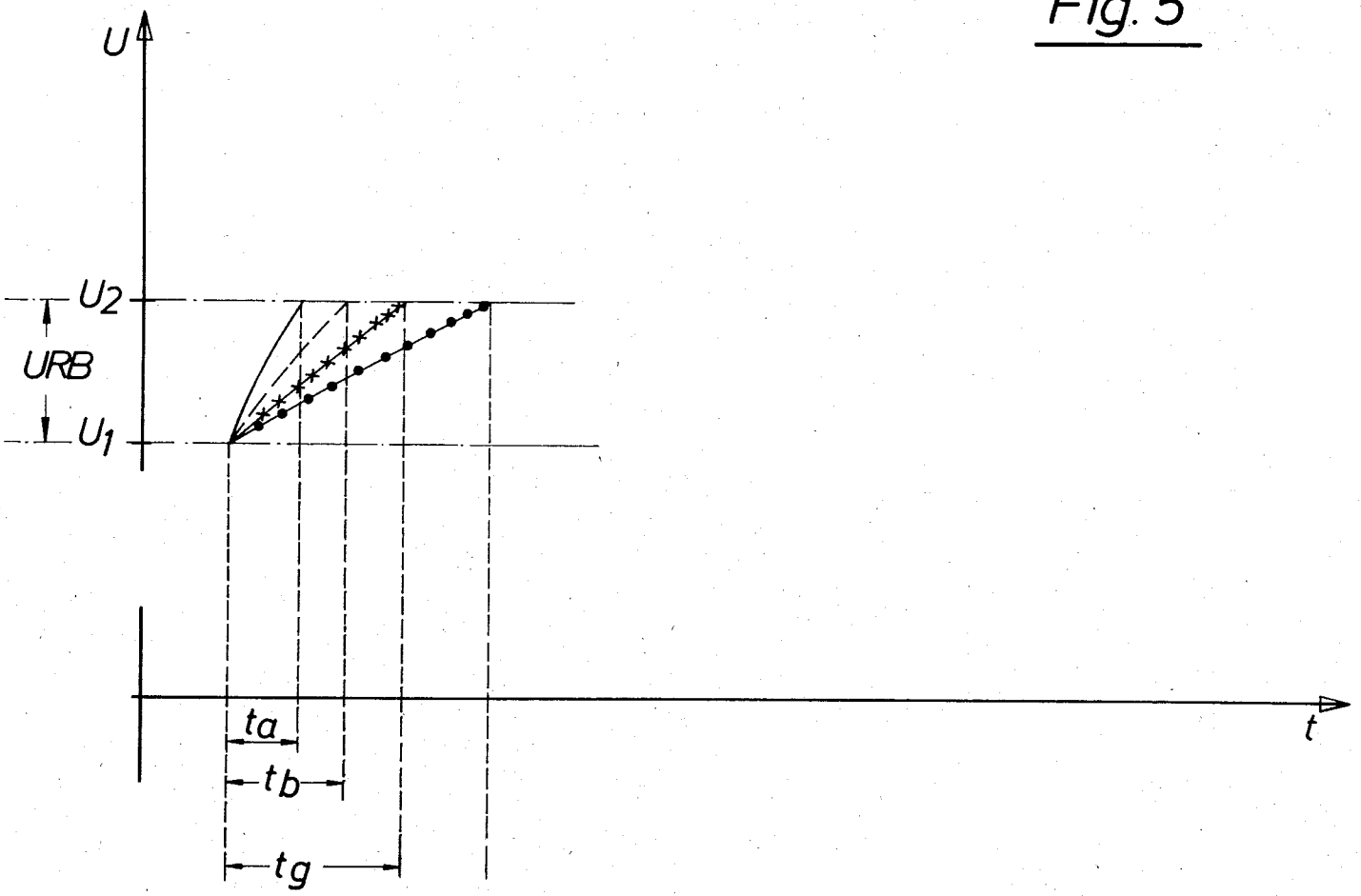

FIG. 4 is a graphical representation of how the voltage U across the release capacitance means in the foregoing circuitry varies with time, with the different charging times for the capacitance means being shown for the different battery charge conditions; and FIG. 5 is a graphical representation of the variation of voltage on a release capacitance means in accordance with another embodiment of the invention.

Figure 1:
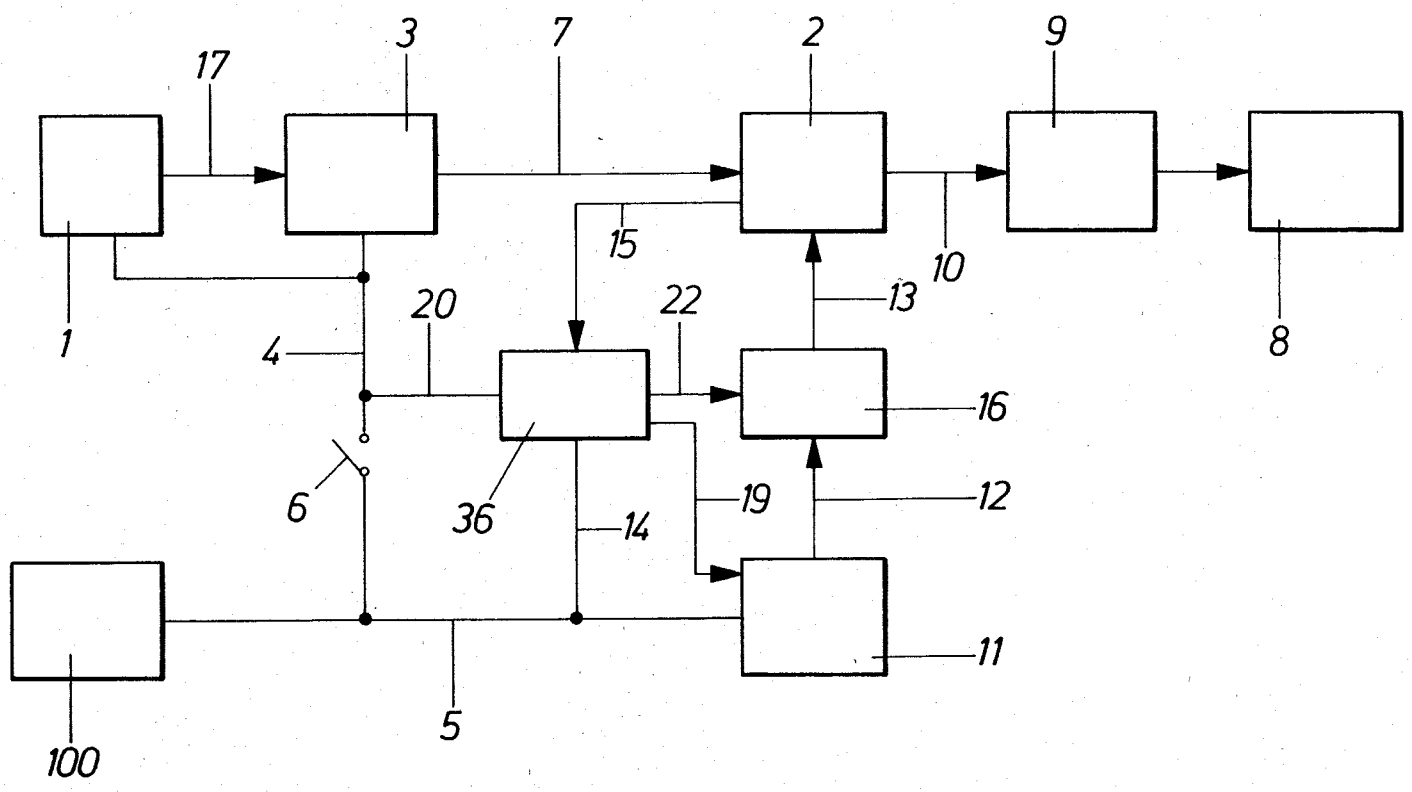
FIG. 1 shows a block diagram of an electronic ski binding of the invention.

FIG. 1 shows schematically the essential parts of an electronic ski binding. The electronic ski binding comprises in essence a transducer 1, a release circuit means 3, a release capacitance means 2 and an electro-mechanical transducer 9. The electro-mechanical transducer 9, when actuated, is adapted to actuate a mechanical ski binding part 8 such that the ski boot is released from the binding. A battery 100 supplies electrical energy to the transducer 1 and to the release circuit 3. Further, the battery 100 supplies the release capacitor 2 with electrical energy via a voltage transformer and a switching element 16. A recharge control means 36, which is described in detail below, is also supplied with electrical energy by battery 100.

The battery 100 supplies electrical energy via a conduit 5, a switch 6 and a conduit 4 to transducer 1 and release circuit means 3. In the condition of nonuse of the ski binding, switch 6 is open. The condition of non-use of the ski binding means that the skier has not yet stepped into the binding with his ski boot.

In accordance with the present invention, the battery 100 is connected with the release capacitance means 2, which can be a capacitor, and continuously charges capacitor 2, i.e., even during the non-use condition of the binding.

The battery 100 is preferably a lithiumthionyl chloride cell having a rated voltage of 3.5 volts. By means of a voltage converter 11, this voltage is amplified and this amplified value is supplied via switch element 16.

As soon as the forces acting on the ski boot exceed a predetermined threshold value, the transducer 1 supplies a release signal via conduit 17 to the release circuit 3. The release circuit 3 in turn supplies a signal via conduit 7 to the release capacitor 2. The release capacitor 2 in turn actuates via conduit 10 the electromechanical transducer 9 which in turn causes the mechanical ski binding part 8 to release.

In accordance with the preferred embodiment of the invention, the release capacitor 2 is maintained during the non-use condition of the binding at an energy value $e_1$ which corresponds to a voltage $U_1$ across the release capacitor 2. This energy value is sufficient to cause at least a single release of the mechanical ski binding part 8.

The release capacitor 2 and all the other parts of the circuit experience losses with the consequence that the charged release capacitor 2 discharges with the passing of time. For this reason, the invention in its preferred form provides that the release capacitor 2 is charged during the non-use condition of the binding to an energy value $e_2$, an energy value which is somewhat larger than the energy value $e_1$. Inasmuch as, particularly due to the losses of release capacitor 2, a certain amount of discharging occurs with time, recharge control means 36 is provided. Recharge control means 36 is supplied via conduit 14 with a supply voltage and via signals transmitted through conduit 15 it is determined what voltage is present across the release capacitor 2. Via a conduit 19 the recharge control 36 controls the voltage converter 11 in such a manner that after the initial charging of the release capacitor to the voltage $U_2$ and after the decrease of the voltage to the voltage $U_1$, again the recharging up to the voltage $U_2$ is effected.

The recharge control 36 is further provided with a signal via conduit 20 as soon as switch 6 is closed. If switch 6 is closed, the release capacitor is—in accordance with the preferred form of the invention—at least charged to an energy value $e_3$, a value which corresponds to the voltage $U_3$ at the release capacitor 2. This energy value $e_3$ is sufficient for at least two releases of the ski binding. Preferably, however, after actuation of the switch 6 when a skier steps into the ski binding, the recharge control 36 activates the voltage transformer 11 via conduit 19 to charge the release capacitor 2 up to an energy value $e_4$ which corresponds to a voltage $U_4$. This energy value $e_4$ is somewhat higher than $e_3$. Due to the losses of the release capacitor, the voltage $U_4$ decreases with time. As soon as the voltage $U_3$ is reached, the circuit element 16 is again actuated via conduit 22 so as to again build up the voltage $U_4$ across the release capacitor 2 by means of the voltage transformer 11. The circuit element 16 is connected via conduits 12, 13 and 22, respectively, to the voltage converter 11, the release capacitor 2 and the recharge control 36, respectively.

Figure 2:
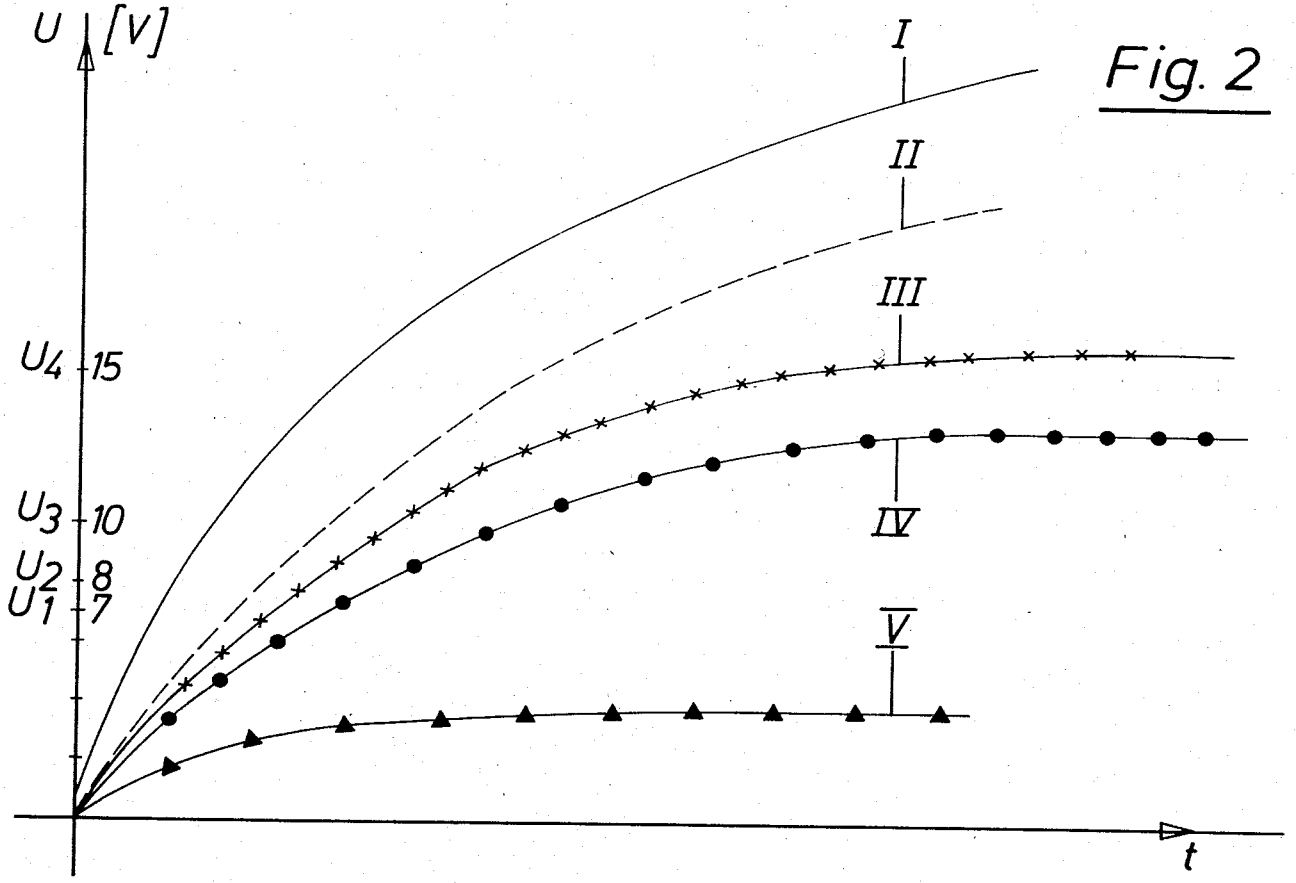
FIG. 2 is a graphic representation of the voltage U over the time t for different charge conditions of a battery in circuitry according to an embodiment of the invention.

FIG. 2 shows in general terms the voltage U across a capacitor over the time t for batteries having different conditions of charge. I refers to a voltage characteristic of a well-charged battery. II refers to a sufficiently charged battery. III is the voltage characteristic of a battery which is barely sufficiently charged, and IV shows the voltage characteristic of a battery which is not sufficiently charged. Eventually, V is the voltage characteristic of another unsufficiently charged battery. The voltages indicated in the Figures are merely examples. The time scale was selected at will.

Figure 3:
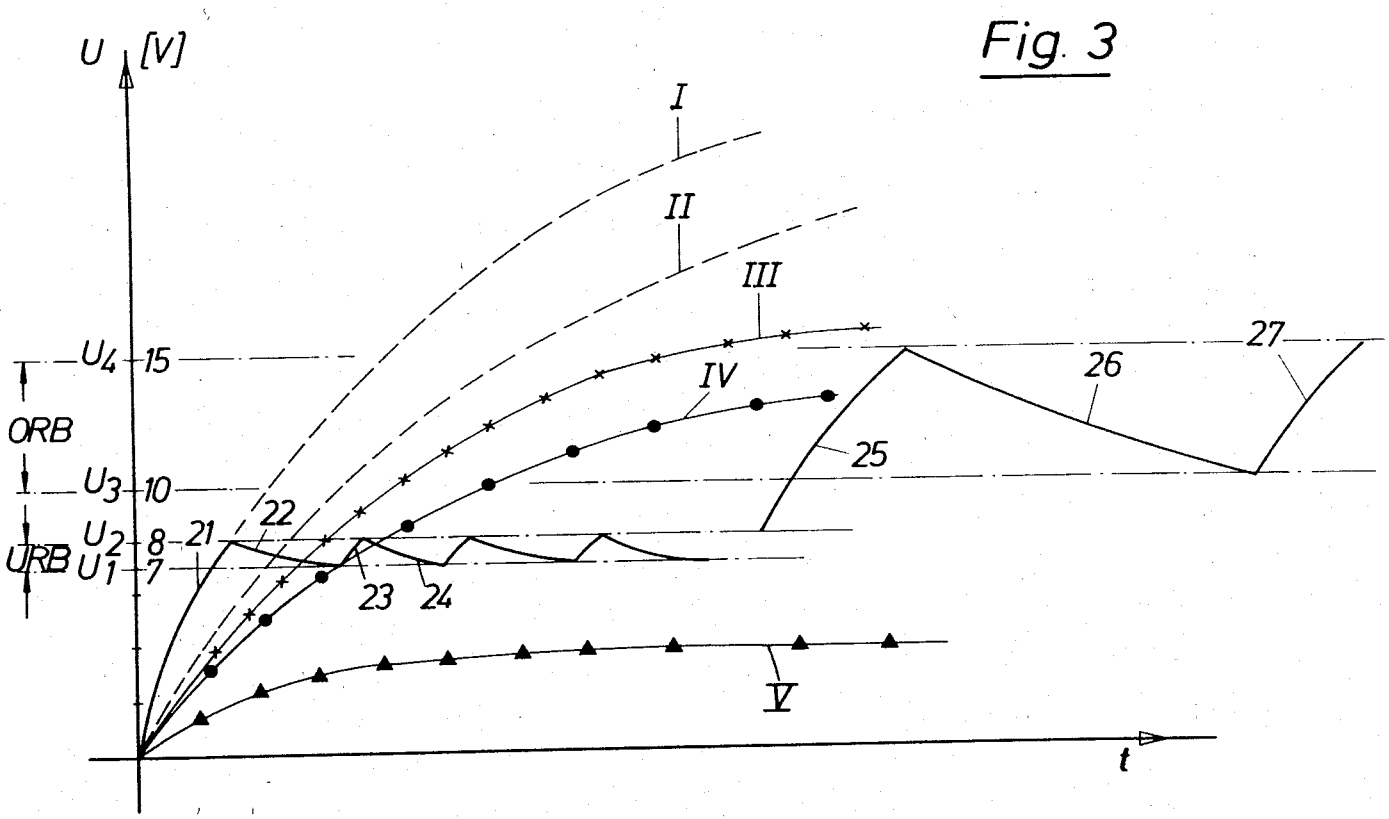
FIG. 3 shows how the voltage U across the release capacitor in the foregoing circuitry varies with time, wherein specifically the charging and discharging of the release capacitance means are shown.

FIG. 3 again shows the voltage characteristics shown in FIG. 1, again designated I, II, III, IV and V. Here again the previously mentioned voltage values $U_1$, $U_2$, $U_3$, $U_4$ are indicated. Specifically, FIG. 3 shows the possible characteristic of voltage U (solid line) across the release capacitor 2.

The first part of curve 21 of the solid characteristic shows the charging of the release capacitor when the battery is initially inserted. During the condition of non-use of the binding, i.e., at a time when the switch 6 is open, the recharge control 36 together with the voltage transformer 11 and the switching element 16 causes the release capacitor 2 to be charged up to the voltage value $U_2$. Because of losses, specifically of the release capacitor 2, the voltage U at the release capacitor decreases as shown by part 22 of the characteristic curve. Eventually, after a certain amount of time has passed, the lower admissible value $U_1$ is reached. As soon as the recharge control 36 detects that the lower admissible value $U_1$ has been reached, the switching element 16 is again turned on and causes the voltage converter 11 to recharge the release capacitor 2 according to part 23 of the (solid line) characteristic curve. After the value $U_2$ is reached, the recharging operation is stopped by means of the recharge control and the recharging of the release capacitor 2 again takes place along part 24 of the characteristic curve. This procedure occurs indefinitely. Naturally the design is chosen such that the time represented by parts 22 and 24, respectively, of the characteristic curve is quite long. Therefore, the voltage across the release capacitor 2 fluctuates during the non-use condition of the ski binding in a lower control area (LCA) between $U_1$ and $U_2$.

When a skier steps with his ski boot into the ski binding, the voltage on release capacitor has some value ranging between $U_1$ and $U_2$, with the consequence that switch 6 is closed. As soon as the recharge control 36 determines this fact, it actuates the voltage converter 11 to supply a higher voltage to the release capacitor 2. In accordance with the invention, a voltage $U_3$ which corresponds to an energy value $e_3$, is supplied to the release capacitor 2. This voltage $U_3$ guarantees that two release operations are possible. Because of the release capacitor inherently having losses, the invention provides that after the step-in operation of the skier into the ski binding, the voltage across the release capacitor 2 is increased up to $U_4$ (corresponding to an energy value of $e_4$), as is shown by the part 25 of the characteristic curve shown in FIG. 3. As soon as the value $U_4$ is reached, the recharge control 36 cuts off the switching element 16, with the consequence that the release capacitor 2 is discharged as indicated by part 26 of the characteristic curve. As soon as the discharge has taken place to a degree where part 26 of the characteristic curve reaches $U_3$, this condition is detected by the recharge control 36 and the switching element 16 is triggered via conduit 22 and becomes switched on again to cause again the recharge of release capacitor 2 up to the value $U_4$. The latter recharge operation is shown in part 27 of the characteristic curve, i.e., starting from the voltage $U_3$.

Therefore, the voltage across the release capacitor 2 fluctuates during the condition of operation of the ski binding between $U_3$ and $U_4$, i.e., in an upper control area (UCA) of the voltage U across the release capacitor 2.

By using the features of the invention, it is provided that the skier, after stepping into the ski binding, can be perfectly sure that, if necessary, the immediate release of the ski binding is guaranteed. It is not necessary for the skier to wait for the charging of the release capacitor up to a voltage value required for the release operation.

Because of the release capacitor being charged up to an energy value which is sufficient for two release operations at the time the skier steps into the binding, sufficient energy is available to guarantee a second release operation immediately following a first release operation.

Another aspects of the preferred form of the present invention is based on the recognition that when using a fully charged battery, a short charging operation is required, while a somewhat longer charging operation is necessary for a partly discharged battery. Therefore, the duration of the charging operation can be considered as a measure for the charge condition of the battery. In accordance with a preferred embodiment of the invention, provision is made to determine the time period required by the charging operation in the upper charging area (UCA). This situation is shown in FIG. 4.

For a fully charged battery—see FIG. 4—the charging operation occurs between $U_3$ and $U_4$ according to line 110, and the time required therefor is designated $t_a$. For a sufficiently (but not fully) charged battery, the charging operation follows line 120 and requires a time designated $t_b$. Line 130 represents the charging operation for a battery which is just barely sufficiently charged, and the time required for this charging operation is designated $t_g$.

In the event that the time required for charging the release capacitor 2 from $U_3$ to $U_4$ is larger than $t_g$, the battery is considered to be inoperative and the skier is notified by an alarm signal that the battery has to be replaced.

In accordance with the invention, the time t required to charge the release capacitor 2 can be measured and compared with the threshold value $t_g$. If the measured or determined time t is smaller than or equal to $t_g$, then the battery is considered to be operative and no alarm signal is generated. If, however, the measured time t is larger than $t_g$, an alarm signal is generated.

Another method for determining the time required for the charging operation, is the determination or measurement of the steepness or slope of the curves 110, 120 and 130, respectively. The slope is correlated with the time necessary for charging and from the amount of slope, the time required for charging may be determined. The embodiment of FIG. 4 discloses that the upper control area (UCA) of the characteristic curve is used for determining the charge condition of the battery. FIG. 5 shows an embodiment according to which the lower control area (LCA) is used to determine the charge condition of the battery 100.

The circuit components required for carrying out the method disclosed in FIGS. 4 and 5 may be arranged in the recharge control 36. The recharge control 36 determines when the situation occurs where the threshold value $t_g$ is exceeded and releases thereupon an alarm means (not shown).

Means are provided in voltage converter 11 which makes sure that the voltage supplied by battery 100 does not go below a minimum voltage value. This minimum voltage value can be 3.0 volts for a lithium-thionylchloride cell. This value of 3.0 volts is absolutely necessary to properly power the electronic of the binding. The means provided in the voltage converter are designed to maintain the minimum voltage even if this would mean that the charging time for the release capacitor 2 would be extended. In accordance with the invention, the battery voltage is controlled during the charging operation of the release capacitor 2 such that it does not fall below a predetermined minimum voltage value (e.g. 3 volts) so that a malfunctioning of the electronic part of the ski binding caused by a battery voltage which is too low, does not occur.

The invention has been described in detail with particular reference to the preferred embodiments thereof, but it should be understood that variations and modifications within the spirit and scope of the invention may occur to those skilled in the art to which the invention pertains.

I claim:

1. An electronic ski binding having a latched condition for retaining a ski boot in the binding and a released condition for releasing a ski boot from the binding, said electronic ski binding comprising:

an energy source for supplying electrical energy to the binding;

transducer means electrically connected to said energy source for generating electrical signals in response to forces applied by a ski boot to said binding;

release circuit means electrically connected to said transducer means for generating release signals when said signals from said transducer means exceed a predetermined value;

release capacitance means electrically connected to said release circuit means for generating actuating signals in response to the generation of release signals by said release circuit means;

electro-mechanical means electrically connected to said release capacitance means for effecting the release of said binding in response to said actuating signals;

recharging means electrically connected to said energy source and to said release capacitance means for connecting said energy source to said release capacitance means for recharging said release capacitance means in response to control signals; and recharge control means electrically connected to said release capacitance means and to said recharging means for determining the energy level of said release capacitance means, and for generating control signals to said recharging means when the energy level of said release capacitance means falls below a first energy value.

2. The invention according to claim 1 wherein the binding has a condition of use during which a boot is retained in the binding and a condition of non-use during which a boot is not retained in the binding, and wherein said recharge control means includes means for comparing the energy level of said release capacitance means with a second energy level when the binding is in the non-use condition, said second energy level being greater than said first energy level, and for generating control signals to said recharging means to connect said energy source to said release capacitance means to raise the energy level of said release capacitance means to said second energy level when said release capacitance means falls below said second energy level to said first energy level.

3. The invention according to claim 2 and further including step-in means for putting said binding in an initial condition of use when a ski boot is initially inserted in the binding to place the binding in the latched condition, and wherein said recharge control means includes means for comparing the energy level of said release capacitance means with a third energy level when the binding is in the initial condition of use, said third energy level being greater than said second energy level, and for generating control signals to said recharge means to connect said release capacitance means to said energy source to raise the energy level of said release capacitance means to said third energy level when said release capacitance means falls below said third energy level while said binding is in said initial condition of use.

4. The invention according to claim 3 wherein said third energy level is adequate to place said binding in the released condition two times.

5. The invention according to claim 1 wherein said release capacitance means has an upper control region when said binding is in the condition of use wherein said release capacitance means is charged to between a further relatively low energy level and a further relatively high energy level, and wherein said recharge control means includes means responsive to the energy level of said release capacitance means in the upper control region for generating control means to said recharge means for connecting said energy source to said release capacitance means to charge said release capacitance means to the further relatively high energy level when the energy level of said release capacitance means drops to said further relatively low energy level.

6. The invention according to claim 5 wherein said recharge control means generates a cut off signal to said recharge means to disconnect said energy source from said energy source when the energy level of said release capacitance means rises to said further relatively high energy level.

7. The invention according to claim 1 wherein said recharge means comprises voltage transforming means connected to said energy source for amplifying the output of said energy source and switching means for selectively connecting said voltage transforming means to said release capacitance means in response to control signals from said recharge control means.

8. The invention according to claim 5 and further including:

charge measuring means for measuring the energy level of said energy source, said charge measuring means including timing means for determining the recharging time required to recharge said release capacitance means from said further relatively low energy level to said further relatively high energy level.

9. The invention according to claim 8 wherein said charge measuring means further includes means for generating a reference time value reflective of a predetermined energy level of said energy source, and means for comparing said recharging time to said reference time value to determine whether the energy level of said energy source is less or greater than said predetermined energy level.

10. An electronic ski binding comprising:

an energy source;

transducer means electrically connected to said energy source for generating electrical signals in response to forces applied by a ski boot to said binding;

release circuit means electrically connected to said transducer means for generating release signals when said signals from said transducer means exceed a predetermined value;

release capacitance means electrically connected to said release circuit means for generating actuating signals in response to the generation of release signals by said release circuit means;

electro-mechanical means electrically connected to said release capacitance means for effecting the release of said binding in response to said signals;

recharging means electrically connected to said energy source and to said release capacitance means for connecting said energy source to saio release capacitance means for recharging said release capacitance means in response to control signals;

recharge control means electrically connected to said release capacitance means and to said recharging means for determining the energy level of said release capacitance means, and for generating control signals to said recharging means when the energy level of said release capacitance means falls to a predetermined low value to recharge said release capacitance means to a predetermined high value; and charge measuring means for measuring the energy level of said energy source, said charge measuring means including timing means for determining the recharging time required to recharge said release capacitance means from said predetermined low level to said predetermined high level.

11. The invention according to claim 10 wherein said charge measuring means further includes means for generating a reference time value reflective of a predetermined energy level of said energy source, and means for comparing said recharging time to said reference time value to determine whether the energy level of said energy source is less or greater than said predetermined energy level.

* * * * *